United States Patent [19]

Foster

[11] 4,037,297

[45] July 26, 1977

[54] FELTING NEEDLE WITH BARBED TIP

[75] Inventor: Edson Perkins Foster, Cato, Wis.

[73] Assignee: Foster Needle Company, Inc., Manitowoc, Wis.

[21] Appl. No.: 689,394

[22] Filed: June 15, 1976

[51] Int. Cl.[2] ..... D04H 18/00

[52] U.S. Cl. ..... 28/115

[58] Field of Search ..... 28/4 R, 4 N, 72.2 R

[56] References Cited

U.S. PATENT DOCUMENTS 3,972,096 8/1976 Ohotnicky ..... 28/4 N

*Primary Examiner*—Louis K. Rimrodt

*Attorney, Agent, or Firm*—Francis J. Bouda

[57] ABSTRACT

A felting needle, having a body with a blade, a tapered point at the outer end of the blade, the blade being non-circular in cross-section and the point being circular in cross-section near the tip, and at least one barb formed in the point area beyond the blade, said barb including a throat and a face, the throat disposed substantially parallel to the longitudinal axis of the needle, and the face disposed at an obtuse angle to the longitudinal axis of the needle.

15 Claims, 5 Drawing Figures

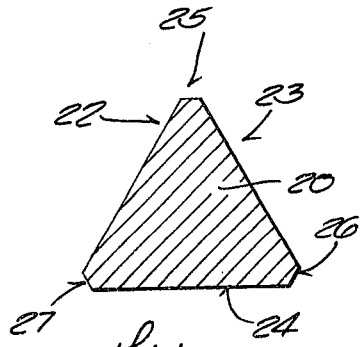
Fig. 3
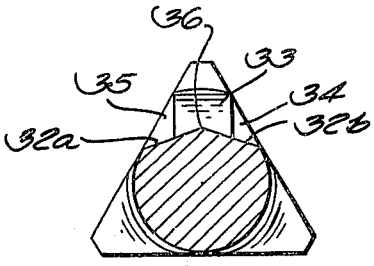
Fig. 4
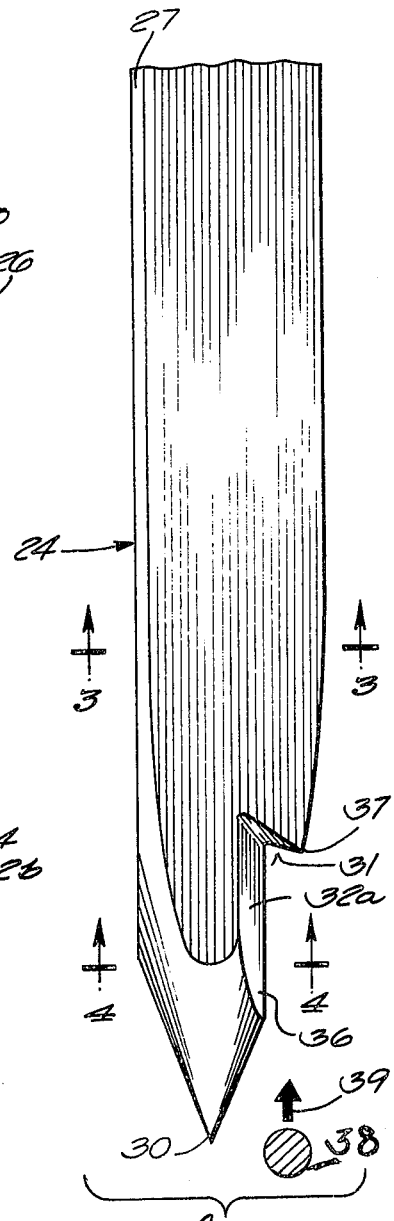
Fig. 2
Fig. 1
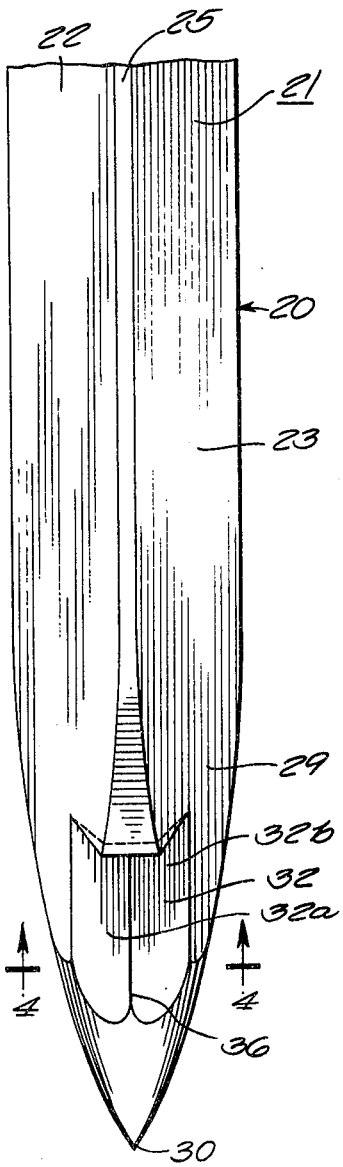

FELTING NEEDLE WITH BARBED TIP

BACKGROUND OF THE INVENTION

Felting needles are not new, and I draw particular attention to my own prior issued U.S. Pat. Nos.: 3,913,189 (1975); 3,479,708 (1969); 3,224,067 (1965); 3,844,004 (1974); 3,390,440 (1968); 2,696,035 (1954); 3,815,186 (1974); 3,353,243 (1967); 2,391,560 (1945); 3,641,636 (1972); 3,307,238 (1967); 2,349,086 (1944).

As is evident, it is not new to make felting needles of triangular cross-section with tapered points and to have the barb disposed in the blade portion along the ridge between the adjacent faces of the triangular cross-section. See particularly my above U.S. Pat. Nos. 3,913,189; 3,844,004; 3,185,186; 3,641,636 and others.

However, none of the prior art disclosures shows a felting needle with the barb disposed in the tapered point portion, nor does any of the prior art show a barb, having a throat parallel to the axis of the needle with the throat extending into the tapered point portion. Nor does the art show a barb like that disclosed in my U.S. Pat No. 3,815,186 wherein the barb is on the point of the needle. All of the prior art, including my own patents, show that the barb is formed in a portion of the blade by cutting, striking, indenting or otherwise upsetting the metal to create a notch having an upset tip and wherein the throat is disposed at an angle to the axis of the blade (i.e., the longitudinal or major axis of the needle).

Moreover, the art in this field, crowded as it is, showing needles and structures with the barbs disposed in the blade portion of the needle, create a needle where the tip of the point is disposed at some distance from the first barb, thus requiring the tip of the needle to pass well into the material before the first barb engages the fibers, and requiring an unnecessarily long travel of the needle in an axial direction, and also requiring that the tip of the needle pass a substantial distance beyond the material, sometime into a hole in the bed-plate before the first of the barbs sufficiently engages the lower fibers of the material to create the desired felting action in the web of the material.

Additionally, the needles in this crowded field, having barbs struck into the side of the blade, and having upset tips on the face of the barbs, force the fibers to move laterally in order to enter the throat of the barb as the needle penetrates the material. The fibers must also move laterally outwardly as the needle is withdrawn from the material. Such lateral movement causes an unnecessary flexing or bending of the needle, irregularities and non-uniformities in the material, and weakening of the needles, leading to breaking of the needles, especially if the material needled is waste material such as "shoddy" having a variety of synthetic fibers, all of which are more difficult to handle in the needle-punching operation.

SUMMARY OF THE INVENTION

The felting needle of the present invention includes a non-circular blade and also a tapered point portion, preferably circular in cross-section at the tip, though it is to be understood that the blade may be triangular in cross-section, or may be a pinch-blade somewhat star-shaped in cross-section, and that the tip of the point may be oval as well as circular in cross-section. It is in the tapered portion that a barb of the present invention is disposed, as close as 1/16 of an inch to the tip. This barb has a longitudinal throat which is substantially parallel to the axis of the needle, and which blends, at its forward end, into the pointed area, and which, at its rearward end, is spaced from the tapered surface of the point to provide a barb face between the throat and the outer surface of the needle, without upsetting or elevating any of the needle material beyond the outer periphery of the needle, as defined by an envelope surrounding the outermost surfaces of the blade. The barb thus created, is disposed closer to the point of the needle than has been heretofore been found possible.

Thus the felting needle of the present invention is found to be relatively simple and uncomplicated, having a barb formed very near the tip of the needle and providing a felting action closer to the tip than has heretofore been found possible.

A principal object of the present invention is to provide a felting needle with a barb having a material engaging surface and with the barb formed in a ridged portion of the tapered tip portion close to the point of the needle.

A further object of the present invention is to provide a barb in the tapered tip portion of a felting needle, with said barb having a throat disposed substantially parallel to the axis of the needle.

An additional object of the present invention is to provide a felting needle which requires less axial travel to accomplish the felting action, by having a barb disposed unusually close to the tip of the needle.

Still another object of the present invention is to provide felting apparatus having a plurality of needles therein with the needles having tapered tips and barbs disposed in the tapered portions, closely adjacent the tip, so as substantially to reduce the axial travel of the needles, and thus to minimize the energy consumed and to simplify the needling operation.

With the above and other objects in view, more information and understanding of the present invention may be achieved by reference to the following detailed description.

DETAILED DESCRIPTION

For the purpose of illustrating the invention, there is shown in the accompanying drawings a form thereof which is at present preferred, although it is to be understood that the various instrumentalities of which the invention consists can be variously arranged and organized and that the invention is not limited to the precise arrangements and organizations of the instrumentalities as herein shown and described.

In the drawings, wherein like reference characters indicate like parts:

FIG. 1 is a fragmentary top plan view of the end of the blade of the felting needle of the present invention.

FIG. 2 is a side elevational view, fragmentary in nature, of the same needle shown in FIG. 1.

FIG. 3 is a cross-sectional view taken generally along lines 3—3 of FIG. 2.

FIG. 4 is a cross-sectional view taken generally along lines 4—4 of FIGS. 1 and 2.

Figure 5:
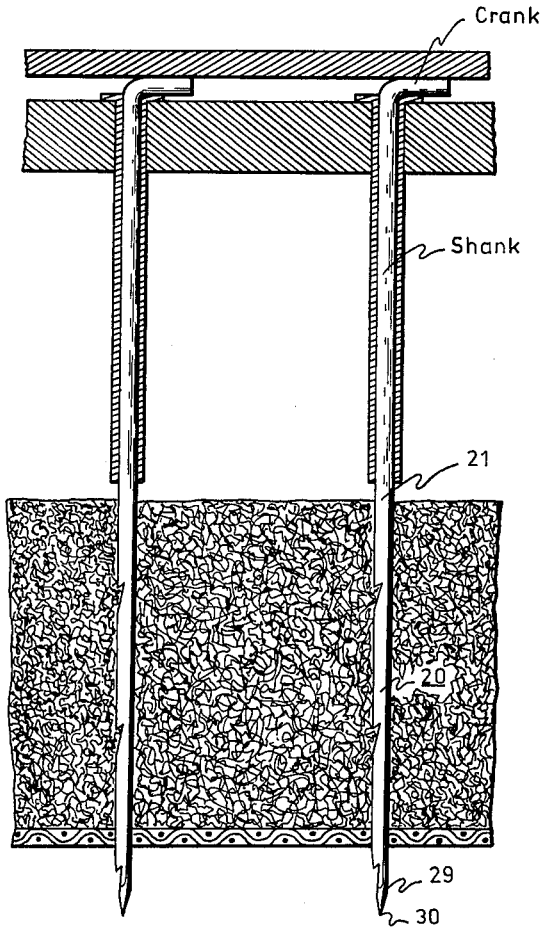
FIG. 5 is a vertical cross-sectional view of a plurality of needles of the present invention mounted in a needle board and operatively disposed in a batt of fibers.

In FIG. 1, the blade 20 of a felting needle 21 is generally triangular in cross-section, as shown more clearly in FIG. 3, and this blade 20 includes the faces 22, 23, and 24, which meet to form, respectively, the ridges between the faces, as indicated at 25, 26, and 27.

It is generally in such ridges 25, 26, and 27 that the usual barbs are formed in conventional felting needles, as taught in the prior art.

The outer end of the needle beyond the Section 3—3 provides a point 29 which decreases in diameter from Section 3—3 to the tip 30. The point 29 is substantially circular in cross-section as is shown in FIG. 4, blending in with the flat faces 22, 23, and 24 as the point 29 increases in diameter toward the Section line 3—3. Rearwardly of this Section line the circular envelope defines the ridges 25, 26, and 27.

The point 29 from Section 3—3 to the tip 30 is approximately ¼ of an inch long. It is in the tapered point 29 that the unique barb 31 of the present invention is located, as shown clearly in FIGS. 1 and 2. The barb 31 includes a throat 32, a face 33, and side walls 34 and 35 all disposed within the peripheral outline or envelope of the tapered point 29 and flat faces 22, 23, and 24.

As is particularly shown in FIG. 2, the throat 32 may be formed by a plurality of inclined surfaces **32*a* and 32*b* with a ridge 36 therebetween, disposed substantially parallel to the major axis of the needle. Thus the fibers may enter the barb along the axially-moving ridge 31 as the needle is forced into the material, coming into contact with the angularly inclined face 33 and draping rearwardly against the side walls 34 and 35.**

I have found that a preferred angle of the face 33 is somewhere between 5° and 20° from a perpendicular to the ridge 36, and this angle may be altered as the requirements of the materials or the fibers demand. However, as is clearly shown in FIG. 2, the edge 37 of the barb 31 does not extend beyond the envelope of the tapered point 29, while yet providing an adequate and satisfactory surface against which to engage the fibers of the material to be needled.

As is shown particularly in FIG. 1, the ridge 25 widens out at the forward end as it blends into the tapered tip 29 to provide the broader edge 37, maximizing the width of the face 33 and thus minimizing the cutting effect of the barb on any fiber.

Reference to FIG. 2 also clearly shows a fiber 38 about to enter the throat of the barb 31 in direction of the arrow 39, and thus it can be caught against the face 33 without any transverse displacement of either the needle or the fiber, and such capturing action can take place within 1/16 inch of the tip 30.

It is possible that additional barbs 31 can be located within the tapered point 29 in line with ridges 26 and 27, and I have found it possible to create as many as 3 barbs on the tapered point by spiralling sucessive barbs around the needle on ridge 25, ridge 26 and ridge 27.

It is to be understood that the present invention may be embodied in other specific forms without departing from the spirit or special attributes hereof, and it is therefore desired that the present embodiments be considered in all respects as illustrative, and therefore not restrictive, reference being made to the appended Claims rather than to the foregoing description to indicate the scope of the invention.

Having thus described my invention, what I claim as new and desire to protect by Letters Patent are the following:

1. A barbed felting needle having a non-circular blade portion with a plurality of faces and with a ridge between each pair of adjacent faces, a tapered point portion at the outermost end of the blade portion converging to a tip, at least one barb disposed in the tapered point between the tip and the blade portion.

2. The needle of claim 1 wherein said barb has a face, a throat, and side walls, said face being defined by (1) an edge which is the rearward end of the throat, (2) the forward edges of the spaced-apart side walls, and (3) the forward edge of a portion of a ridge within the tapered point.

3. The needle of claim 1 wherein the barb is disposed entirely within the tapered point.

4. The needle of claim 1 wherein the barb is disposed substantially within the tapered point.

5. The needle of claim 1 wherein the barb has a throat and a face, the throat having a base disposed substantially parallel to the major axis of the needle.

6. The needle of claim 5 wherein the throat has two surfaces defining a ridge therebetween, and the ridge is disposed substantially parallel to the major axis of the needle.

7. The needle of claim 5 wherein the throat is flat.

8. The needle of claim 5 wherein the face is disposed at an obtuse angle to the major axis of the needle and wherein the outer tip of the barb is disposed within the periphery of the tapered portion and is defined by one of the said ridges.

9. The needle of claim 1 with at least a second barb disposed in the tapered point portion.

10. The needle of claim 1 wherein the blade portion is triangular in cross-section.

11. The needle of claim 1 wherein the blade portion is a pinch blade generally star-shaped in cross-section.

12. The needle of claim 1 wherein the barb in the tapered point portion is disposed between 1/16 and ⅛ of an inch of the tip of the needle.

13. A needle punching machine having a plurality of needles therein, at least some needles having a crank, a shank, a blade and a tapered point portion, the tapered point being generally circular in cross-section, and at least one barb formed entirely in the tapered point of the needle, said barb having a throat and a face both disposed within the tapered portion and with the throat parallel to the longitudinal axis of the needle.

14. The needle punching machine of claim 13 wherein those needles having barbs in the tapered point portion each has at least one barb disposed within 1/16 of an inch of the tip of the needle.

15. The needle punching machine of claim 13 wherein the farthest axial travel of the tip of the needles does not extend more than 1/16 inch beyond the far side of the material being needled.

* * * * *